US009354585B2

(12) United States Patent
Iikura et al.

(10) Patent No.: US 9,354,585 B2
(45) Date of Patent: May 31, 2016

(54) CONTACT MEMBER, IMAGE CARRIER, AND IMAGE FORMING APPARATUS

(71) Applicant: FUJI XEROX CO., LTD., Tokyo (JP)

(72) Inventors: Kazuaki Iikura, Kanagawa (JP); Hiroshi No, Kanagawa (JP); Koji Tadokoro, Kanagawa (JP); Shinya Makiura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/445,444

(22) Filed: Jul. 29, 2014

(65) Prior Publication Data

US 2015/0078783 A1 Mar. 19, 2015

(30) Foreign Application Priority Data

Sep. 17, 2013 (JP) ..... 2013-192157
May 29, 2014 (JP) ..... 2014-111293

(51) Int. Cl.
*G03G 15/00* (2006.01)

(52) U.S. Cl.
CPC ..... *G03G 15/751* (2013.01)

(58) Field of Classification Search
CPC ..... G03G 15/75
See application file for complete search history.

(56) References Cited

FOREIGN PATENT DOCUMENTS

| | | |
|---|---|---|
| JP | A-5-158387 | 6/1993 |
| JP | A-8-202206 | 8/1996 |
| JP | A-2000-315036 | 11/2000 |

OTHER PUBLICATIONS

Office Action issued in Japanese Patent Application No. 2014-111293 dated Aug. 19, 2014 (with translation).

*Primary Examiner* — David Gray
*Assistant Examiner* — Sevan A Aydin
(74) *Attorney, Agent, or Firm* — Oliff PLC

(57) ABSTRACT

A contact member is fitted in a cylindrical body that is substantially cylindrical and configurates an image carrier, and is supported by the cylindrical body while being in contact with an inner peripheral surface of the cylindrical body at contact portions provided in three areas in a circumferential direction of the cylindrical body. All angles formed by two of straight lines passing through the contact portions and an axial center of the cylindrical body are more than about 90 degrees in a state in which the contact member is supported within the cylindrical body, when viewed from an axial direction of the cylindrical body.

8 Claims, 13 Drawing Sheets

CONTACT MEMBER, IMAGE CARRIER, AND IMAGE FORMING APPARATUS

CROSS-REFERENCE TO RELATED APPLICATIONS

This application is based on and claims priority under 35 USC 119 from Japanese Patent Applications No. 2013-192157 filed Sep. 17, 2013 and No. 2014-111293 filed May 29, 2014.

BACKGROUND

1. Technical Field

The present invention relates to a contact member, an image carrier, and an image forming apparatus.

2. Summary

According to an aspect of the invention, there is provided a contact member fitted in a cylindrical body that is substantially cylindrical and configurates an image carrier, and supported by the cylindrical body while being in contact with an inner peripheral surface of the cylindrical body at contact portions provided in three areas in a circumferential direction of the cylindrical body. All angles formed by two of straight lines passing through the contact portions and an axial center of the cylindrical body are more than about 90 degrees in a state in which the contact member is supported within the cylindrical body, when viewed from an axial direction of the cylindrical body.

BRIEF DESCRIPTION OF THE DRAWINGS

Exemplary embodiments of the present invention will be described in detail based on the following figures, wherein.

DETAILED DESCRIPTION

First Exemplary Embodiment

A contact member, an image carrier, and an image forming apparatus according to a first exemplary embodiment of the present invention will be described with reference to FIGS. 1A, 1B, and 1C to FIGS. 7A and 7B. In the figures, arrow H shows an apparatus up-down direction (vertical direction), arrow W shows an apparatus width direction (horizontal direction), and arrow D shows an apparatus depth direction (horizontal direction).

Overall Configuration

Figure 4:
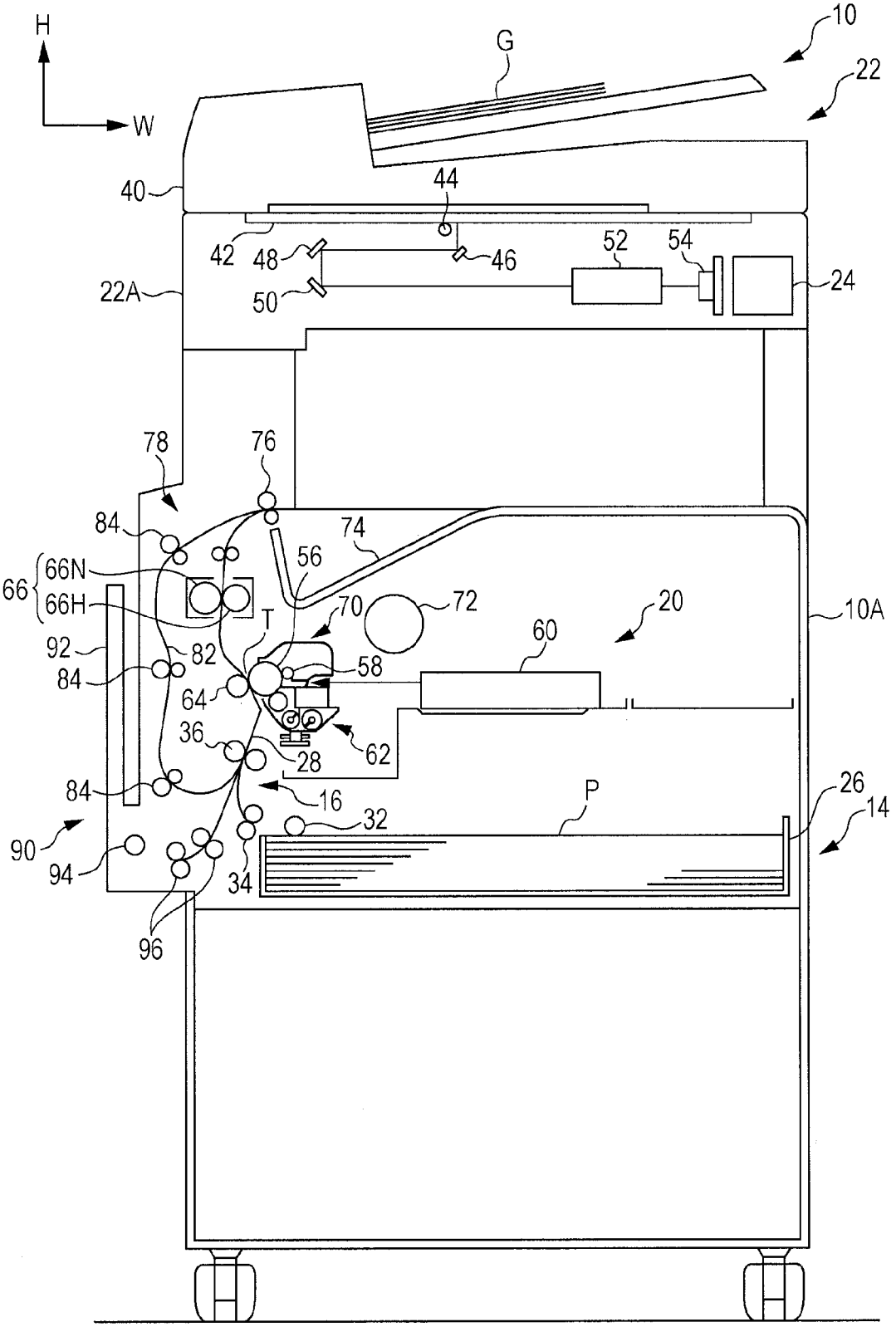
FIG. 4 is a schematic structural view of the image forming apparatus according to the first exemplary embodiment.

As illustrated in FIG. 4, in an image forming apparatus 10 according to the first exemplary embodiment, a storage section 14, a transport section 16, an image forming section 20, and a document reading section 22 are provided in this order from a lower side toward an upper side in the apparatus up-down direction (direction of arrow H). The storage section 14 stores sheet members P serving as recording media. The transport section 16 transports the sheet members P stored in the storage section 14. The image forming section 20 forms images on the sheet members P transported from the storage section 14 by the transport section 16. The document reading section 22 reads a read document G. The image forming apparatus 10 further includes a manual paper feed section 90 from which a sheet member P is supplied manually.

Storage Section

The storage section 14 includes a storage member 26 that can be drawn out from an apparatus body 10A of the image forming apparatus 10 toward a front side in the apparatus depth direction. In the storage member 26, sheet members P are stacked. The storage section 14 further includes a feed roller 32 that feeds out the stacked sheet members P to a transport path 28 that configurates the transport section 16.

Transport Section

The transport section 16 includes separation rollers 34 disposed on a downstream side of the feed roller 32 in a transport direction of sheet members P (hereinafter simply referred to as a "transport-direction downstream side") to separate and transport the sheet members P one by one.

On the transport-direction downstream side of the separation rollers 34 in the transport path 28, registration rollers 36 are disposed to temporarily stop a sheet member P and to feed out the sheet member P to a transfer position T (to be described later) at a predetermined timing.

At a terminal end of the transport path 28, output rollers 76 are disposed to output a sheet member P, on which an image is formed by the image forming section 20, into an output portion 74 provided in an upper part of the image forming section 20.

To form images on both sides of a sheet member P, a double-side transport unit 78 for inverting the sheet member P is provided in a side part of the apparatus body 10A. The double-side transport unit 78 includes a reverse path 82 into which a sheet member P is transported by reversing the output rollers 76. Further, plural transport rollers 84 are disposed along the reverse path 82. The sheet member P sent by the transport rollers 84 is transported to the registration rollers 36 again in an inverted state.

Manual Paper Feed Section

Next to the double-side transport unit 78, the folding manual paper feed section 90 is provided. The manual paper feed section 90 includes an openable manual paper feed member 92. The manual paper feed section 90 further includes a paper feed roller 94 and plural transport rollers 96 that transport a sheet member P fed from the open manual paper feed member 92. The sheet member P transported by the transport rollers 96 is transported to the registration rollers 36.

Document Reading Section

The document reading section 22 provided in the upper part of the image forming apparatus 10 includes a light source 44 that radiates light onto a read document G transported by an automatic document transport device 40 for transporting the read document G or a read document G placed on a platen glass 42.

The document reading section 22 further includes an optical system configurated by a full-rate mirror 46, a half-rate mirror 48, a half-rate mirror 50, and an imaging lens 52. Light radiated from the light source 44 is reflected by a read document G, and the reflected light is reflected by the full-rate mirror 46 in a direction parallel to the platen glass 42. The half-rate mirror 48 reflects the reflected light from the full-rate mirror 46 in a downward direction. The half-rate mirror 50 reflects and folds back the reflected light from the half-rate mirror 48 in the direction parallel to the platen glass 42. The reflected light folded back by the half-rate mirror 50 enters the imaging lens 52.

The document reading section 22 further includes a photoelectric conversion element 54 that converts the reflected light imaged by the imaging lens 52 into electric signals, and an image processing unit 24 that subjects the electric signals converted by the photoelectric conversion element 54 to image processing.

The light source 44, the full-rate mirror 46, the half-rate mirror 48, and the half-rate mirror 50 are movable along the platen glass 42. To read a read document G placed on the platen glass 42, the light source radiates light onto the read document G while moving the light source 44, the full-rate mirror 46, the half-rate mirror 48, and the half-rate mirror 50. Reflected light from the read document G is imaged on the photoelectric conversion element 54.

To read a read document G transported by the automatic document transport device 40, the light source 44, the full-rate mirror 46, the half-rate mirror 48, and the half-rate mirror 50 are stopped. The light source 44 radiates light onto the read document G, and reflected light from the read document G is imaged on the photoelectric conversion element 54.

Image Forming Section

Figure 3:
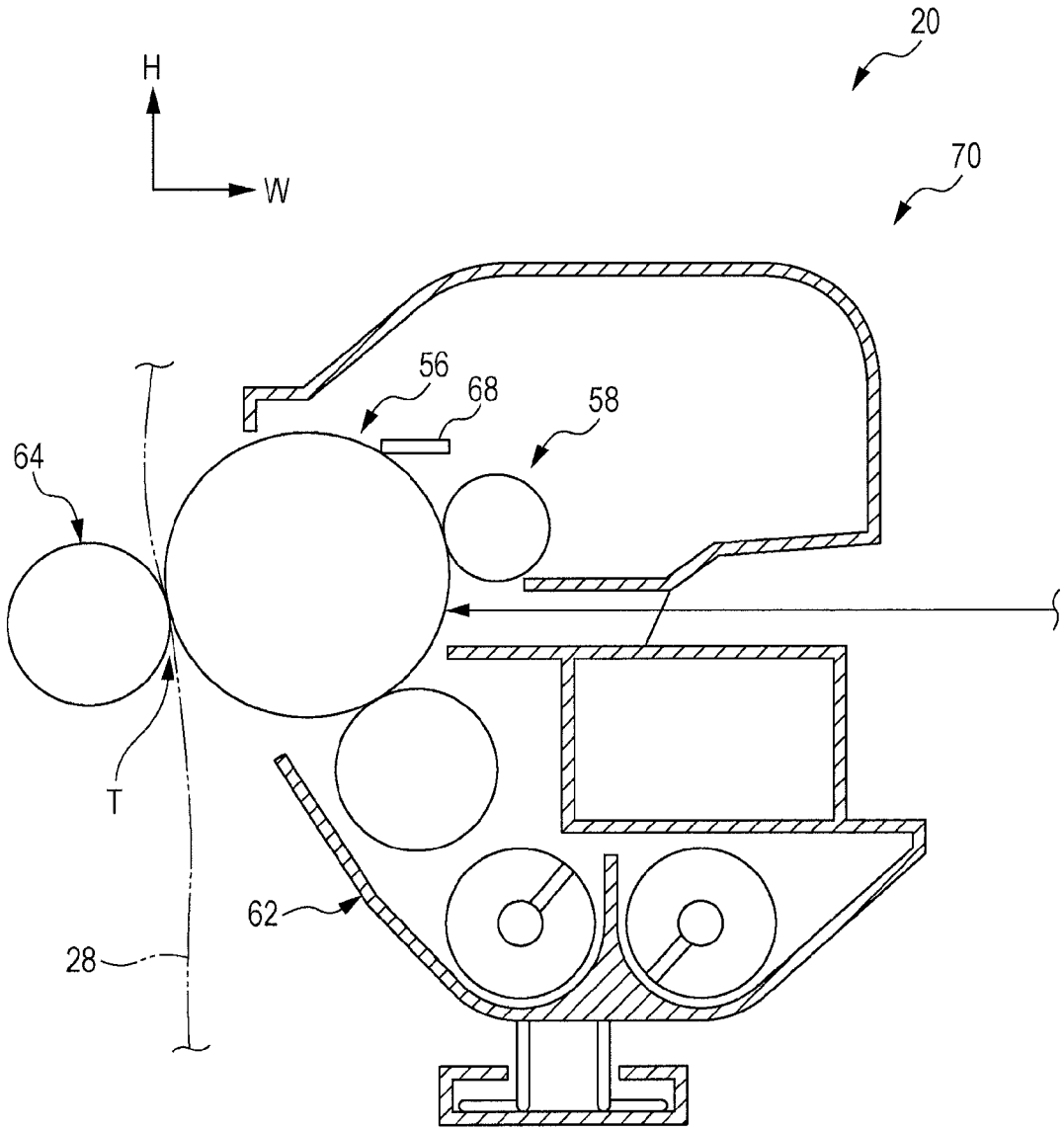
FIG. 3 is a schematic structural view of an image forming unit used in an image forming apparatus according to the first exemplary embodiment.

As illustrated in FIG. 3, the image forming section 20 includes an image carrier 56, a charging roller 58, an exposure device 60 (see FIG. 4), and a developing device 62. The charging roller 58 charges a surface of the image carrier 56. The exposure device 60 forms an electrostatic latent image by radiating exposure light onto the surface of the image carrier 56 charged according to image data. The developing device 62 develops the electrostatic latent image into a visible toner image.

The image forming section 20 further includes a transfer roller 64, a fixing device 66 (see FIG. 4), and a cleaning blade 68. The transfer roller 64 transfers a toner image formed on the surface of the image carrier 56 onto a sheet member P transported along the transport path 28. The fixing device 66 is composed of a heating roller 66H and a pressurizing roller 66N, and fixes the toner image on the sheet member P with heat and pressure. The cleaning blade 68 cleans the image carrier 56 by scraping residual toner off the image carrier 56 after the toner image is transferred.

As illustrated in FIG. 4, a toner cartridge 72 connected to the developing device 62 by an unillustrated supply pipe is disposed on an obliquely upper side of the exposure device 60. The toner cartridge 72 is filled with toner to be supplied to the developing device 62 through the supply pipe.

In this configuration, when a sheet member P is fed out from the registration rollers 36, it is transported to the transfer position T defined by the image carrier 56 and the transfer roller 64 and is transported while being nipped between the image carrier 56 and the transfer roller 64. Thus, a toner image formed on the image carrier 56 is transferred onto the sheet member P.

Here, the image carrier 56, the charging roller 58, the developing device 62, and the cleaning blade 68 configurate an image forming unit 70. The image forming unit 70 is removably mounted the apparatus body 10A.

The image carrier 56, the charging roller 58, and so on will be described in detail later.

Operation of Overall Configuration

In the image forming apparatus 10, an image is formed in the following procedure.

First, the charging roller 58 to which voltage is applied uniformly and negatively charges the surface of the image carrier 56 with a predetermined potential. Next, the exposure device 60 forms an electrostatic latent image by radiating exposure light onto the charged surface of the image carrier 56 on the basis of image data read by the document reading section 22 or externally input data.

The electrostatic latent image corresponding to the image data is thereby formed on the surface of the image carrier 56. This electrostatic latent image is developed into a visible toner image by the developing device 62.

A sheet member P is fed out from the storage member 26 into the transport path 28 by the feed roller 32 or is fed from the manual paper feed member 92 into the transport path 28 by the paper feed roller 94, and is sent to the transfer position T by the registration rollers 36 at a predetermined timing. At the transfer position T, the sheet member P is transported while being nipped between the image carrier 56 and the transfer roller 64, and the toner image formed on the surface of the image carrier 56 is thereby transferred onto a front surface of the sheet member P.

The transferred toner image is fixed on the sheet member P by passing between the heating roller 66H and the pressurizing roller 66N provided in the fixing device 66. Then, after the toner image is fixed on the front surface of the sheet member P, the sheet member P is output to the output portion 74 by the output rollers 76.

To also form an image on a back surface of the sheet member P, the sheet member P having the toner image on its surface is not output to the output portion 74, but is sent to the reverse path 82 by reversing the output rollers 76. Thus, the sheet member P is inverted, and the transport rollers 84 transport the sheet member P to the registration rollers 36 again.

This time, a toner image is transferred onto the back surface of the sheet member P at the transfer position T, and the sheet member P is then output to the output portion 74 in the above-described procedure.

Structure of Principal Part

Next, the image carrier 56, the charging roller 58, and so on will be described.

Charging Roller

Figure 2:
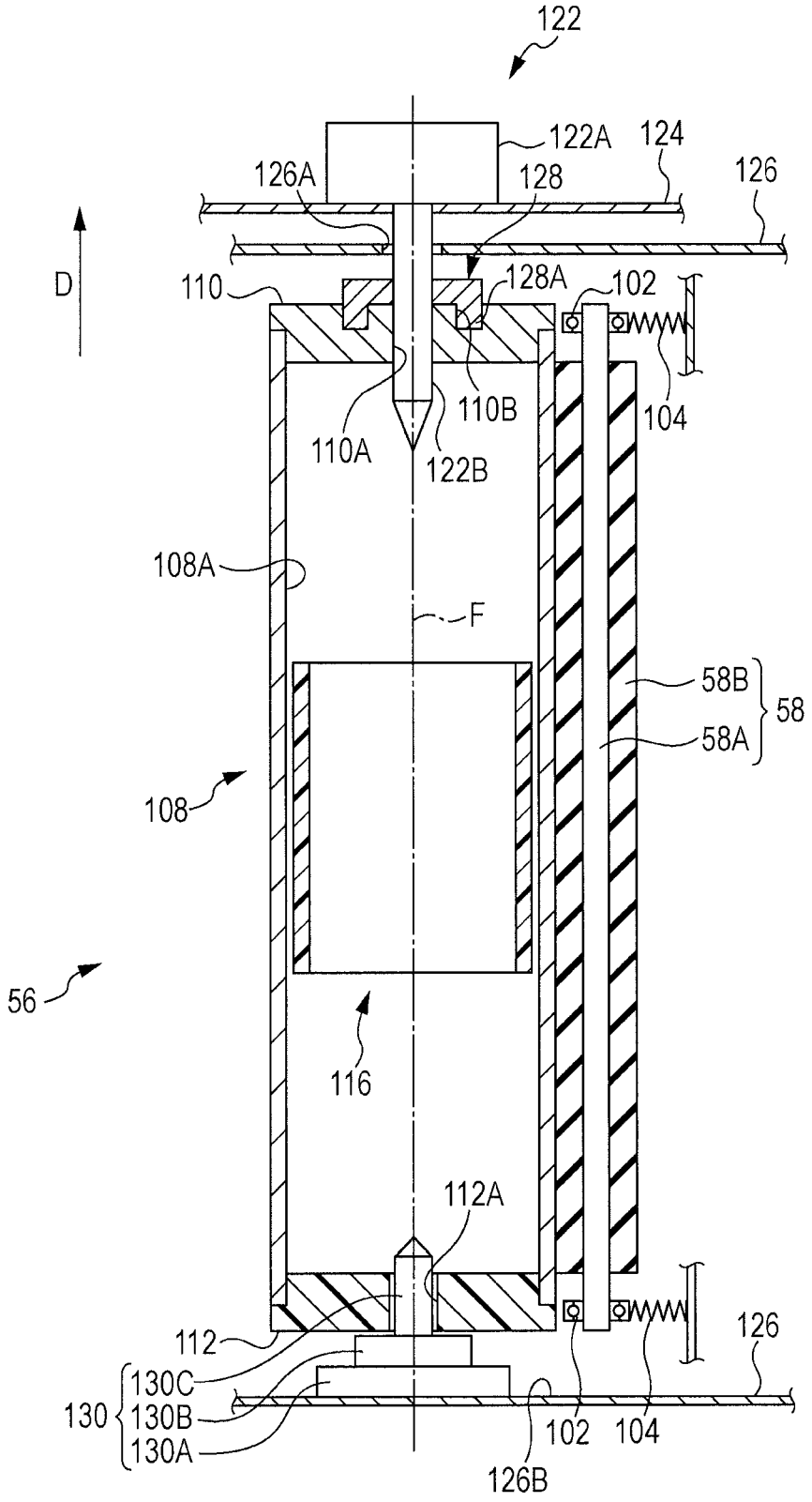
FIG. 2 is a cross-sectional view of an image carrier and so on according to the first exemplary embodiment.

As illustrated in FIG. 2, the charging roller 58 includes a shaft portion 58A extending in the apparatus depth direction and made of a metal material (for example, stainless steel), and a cylindrical roller portion 58B made of a rubber material and formed in a shape of a cylinder in which the shaft portion 58A extends.

Both ends of the shaft portion 58A are exposed outside from the roller portion 58B, and are rotatably supported by a pair of bearing members 102. Biasing members 104 for biasing the bearing members 102 toward the image carrier 56 are disposed on a side of the shaft portion 58A opposite from the image carrier 56. With this structure, the roller portion 58B of the charging roller 58 is pressed against the image carrier 56. When the image carrier 56 rotates, the charging roller 58 is rotated along with the rotation.

To the shaft portion 58A, a superposed voltage obtained by superimposing an alternating-current voltage to a direct-current voltage is applied from an unillustrated power supply.

Image Carrier

As illustrated in FIG. 2, the image carrier 56 includes a cylindrical body 108, a transmission member 110, and a support member 112. The cylindrical body 108 extends in the apparatus depth direction and is cylindrical or substantially cylindrical. The transmission member 110 is fixed to one end (upper side in the figure) of the cylindrical body 108 in the apparatus depth direction (direction similar to an axial direction of the cylindrical body 108 in the first exemplary embodiment). The support member 112 is fixed to the other end (lower side in the figure) of the cylindrical body 108 in the apparatus depth direction. The image carrier 56 further includes a contact member 116 disposed within the cylindrical body 108 to suppress deformation of a cross section of the cylindrical body 108.

The cylindrical body 108 is obtained by forming a photosensitive layer on an outer surface of a cylindrical base member made of a metal material (for example, aluminum).

The transmission member 110 is made of a resin material and formed in a disc shape. The transmission member 110 is fixed to the one end of the cylindrical body 108 with a part thereof being fitted in the cylindrical body 108, and closes the open one end of the cylindrical body 108. The transmission member 110 has a columnar through hole 110A on an axial center F of the cylindrical body 108. In an outer surface of the transmission member 110 facing outward in the apparatus depth direction, plural (two in FIG. 2) recesses 110B are provided such that the through hole 110A is located therebetween.

The support member 112 is made of a resin material and formed in a disc shape. The support member 112 is fixed to the other end of the cylindrical body 108 with a part thereof being fitted in the cylindrical body 108, and closes the other open end of the cylindrical body 108. The support member 112 has a columnar through hole 112A on the axial center F of the cylindrical body 108.

Figure 1A:
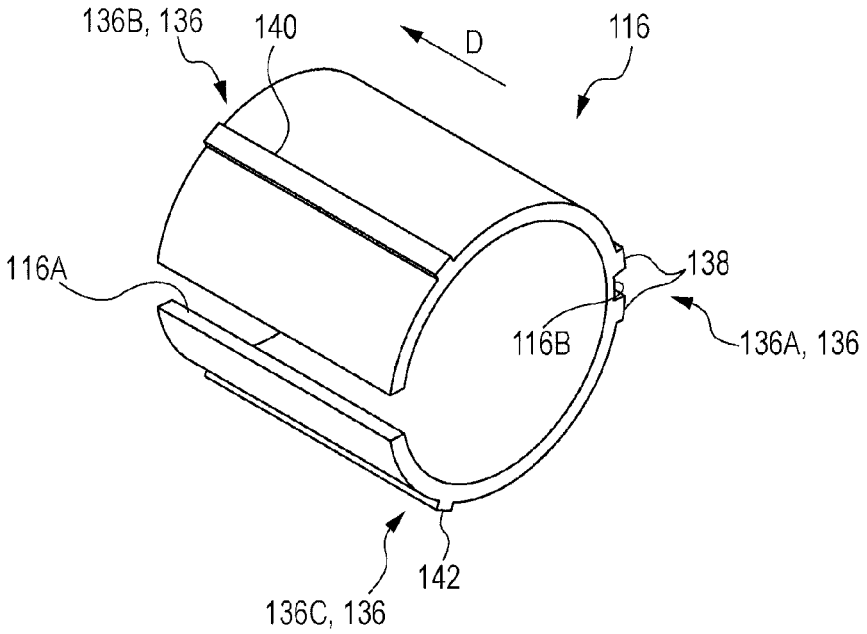
FIGS. 1A, 1B, and 1C are a perspective view, a cross-sectional view, and a cross-sectional view, respectively, of a contact member according to a first exemplary embodiment of the present invention.
Figure 1B:
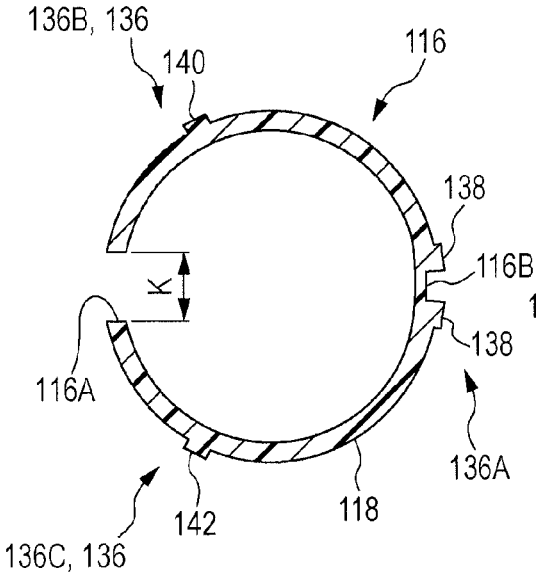
Figure 1C:
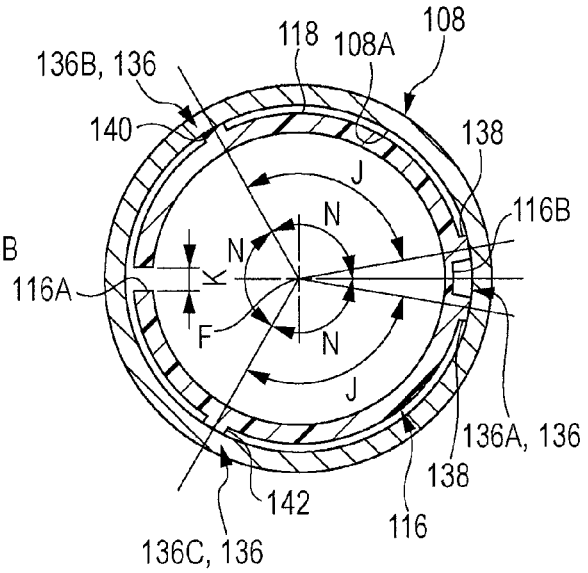

As illustrated in FIG. 2, the contact member 116 is fitted in the cylindrical body 108, and is located in the center of the cylindrical body 108 in the apparatus depth direction. As illustrated in FIG. 1C, the contact member 116 is supported by the cylindrical body 108 while being in contact with an inner peripheral surface 108A of the cylindrical body 108.

Specifically, the contact member 116 is made of a resin material (for example, ABS (acrylonitrile-butadiene-styrene) resin), and is cylindrical or substantially cylindrical (C-shaped) to extend in the apparatus depth direction. The contact member 116 has a separate portion 116A in a circumferential part thereof, as illustrated in FIGS. 1A and 1B. Further, as illustrated in FIG. 1C, a groove portion 116B extending in the apparatus depth direction is provided on a portion of an outer peripheral surface 118 of the contact member 116 on a side of the axial center F opposite from the separate portion 116A in a state in which the contact member 116 is disposed within the cylindrical body 108.

As illustrated in FIG. 1C, the outer peripheral surface 118 of the contact member 116 has contact portions 136 in contact with an inner peripheral surface 108A of the cylindrical body 108. The contact portions 136 extend in the apparatus depth direction, and project in the radial direction. The contact portions 136 are provided in three areas (three positions) on the outer peripheral surface 118. More specifically, when viewed from the apparatus depth direction, the outer peripheral surface 118 has a contact portion 136A composed of a pair of projections 138 disposed on both sides of the groove portion 116B, a contact portion 136B formed by a projection 140 located on one side (counterclockwise side in the figure) of the contact portion 136A, and a contact portion 136C formed by a projection 142 located on the other side (clockwise side in the figure) of the contact portion 136A. That is, the groove portion 116B is provided in the contact portion 136A.

As illustrated in FIG. 1C, in the state in which the contact member 116 is located (supported) within the cylindrical body 108, All angles formed by two of the straight lines passing through circumferential center portions of the contact portions 136 and the axial center F of the cylindrical body 108 (image carrier 56) are 120 degrees (angle N in FIG. 1C).

Further, as illustrated in FIGS. 1B and 1C, in a state in which the contact member 116 is not disposed within the cylindrical body 108, a separate distance (distance K in the figures) of the separate portion 116A is longer than when the contact member 116 is disposed within the cylindrical body 108.

In this structure, when the contact member 116 is disposed within the cylindrical body 108, it is held and bent by deforming the groove portion 116B to shorten the separate distance of the separate portion 116A. In this state, the contact member 116 is inserted into the cylindrical body 108, and the holding force is removed. Thus, the contact portions 136A, 136B, and 136C of the contact member 116 are brought into contact with the inner peripheral surface 108A of the cylindrical body 108, and the contact member 116 is disposed and supported within the cylindrical body 108.

That is, the contact member 116 is disposed in a bent state within the cylindrical body 108.

Others

As illustrated in FIG. 2, a motor 122 is disposed at one side of the image carrier 56 in the apparatus depth direction. The motor 122 serves as an example of a driving source that generates rotational force to be transmitted to the image carrier 56 (transmission member 110).

A body 122A of the motor 122 is attached to a platelike frame 124 disposed within the apparatus body 10A (see FIG. 4). Further, a motor shaft portion 122B of the motor 122 extends on the axial center F of the cylindrical body 108, passes through a through hole 126A provided in a housing 126 of the image forming unit 70 (see FIG. 3), and is inserted in the through hole 110A of the transmission member 110. To an outer peripheral surface of the motor shaft portion 122B, a platelike bracket 128 is fixed such that distal ends thereof are bent and inserted in the recesses 110B of the transmission member 110. Thus, the transmission member 110 is assembled integrally (in a rattle-free state) with the motor shaft portion 122B. The transmission member 110 transmits the rotational force generated by the motor 122 to the cylindrical body 108.

In contrast, a shaft member 130 is disposed at the other side of the image carrier 56 in the apparatus depth direction. The shaft member 130 has a columnar shaft portion 130C that rotatably supports the image carrier 56 (support member 112).

The shaft member 130 is made of a resin material (for example, ABS resin), and includes a pedestal portion 130A attached to an inner side surface 126B of the housing 126, and a stepped portion 130B disposed on the pedestal portion 130A on a side of the image carrier 56 with a height difference. The shaft member 130 further includes a shaft portion 130C extending from the stepped portion 130B on the axial center F of the cylindrical body 108 to be inserted in the through hole 112A of the support member 112.

The support member 112 functions as a so-called sliding bearing for the shaft portion 130C. A gap is provided between an inner peripheral surface of the through hole 112A and an outer peripheral surface of the shaft portion 130C.

In this structure, when the motor 122 is operated, the motor shaft portion 122B rotates. Rotation of the motor shaft portion 122B is transmitted to the cylindrical body 108 via the bracket 128 and the transmission member 110 fixed to the one side of the cylindrical body 108. Then, the support member 112 fixed to the other side of the cylindrical body 108 rotates relative to the shaft portion 130C, and the image carrier 56 is thereby rotated around the axial center F.

Operation of Principal Structure

Next, the operations of the image carrier 56, the charging roller 58, and so on will be described.

When the motor 122 is operated, the image carrier 56 rotates. When the image carrier 56 rotates, the charging roller 58 is rotated along with the rotation. To charge the unillustrated photosensitive layer of the image carrier 56, a superimposed voltage obtained by superimposing an alternating-current voltage on a direct-current voltage is applied from the power supply to the shaft portion 58A of the charging roller 58.

By the alternating-current voltage (1 to 3 kHz) included in the superimposed voltage, an alternating electric field is generated between the charging roller 58 and the image carrier 56. Thus, a periodic electrostatic attractive force (2 to 6 kHz) is generated between the image carrier 56 and the charging roller 58.

Here, an image carrier 200 serving as a first comparative example will be described with reference to FIGS. 5A, 5B, 6A, and 6B in contrast to the image carrier 56 of the first exemplary embodiment, and an image carrier 204 serving as a second comparative example will be described with reference to FIGS. 7A and 7B in contrast to the image carrier 56 of the first exemplary embodiment.

First, the image carrier 200 will be described. The image carrier 200 has a structure similar to that of the image carrier 56 except that the contact member 116 is not provided.

Figure 5A:
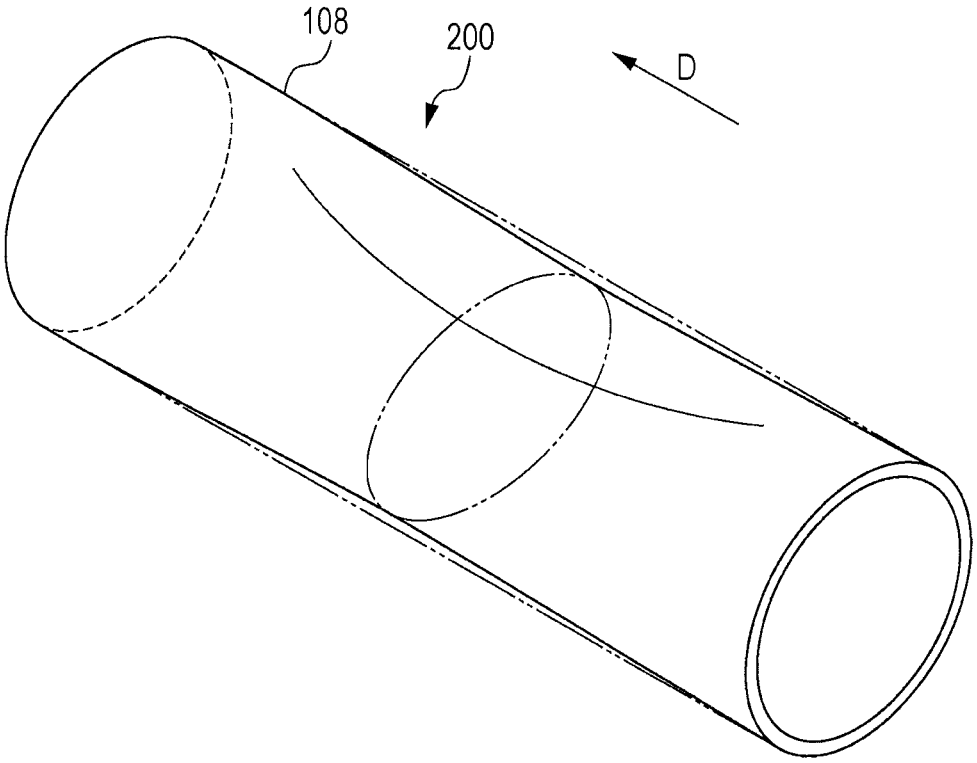
FIGS. 5A and 5B are a perspective view and a cross-sectional view, respectively, illustrating a deformed state of an image carrier according to a first comparative example in contrast to the image carrier of the first exemplary embodiment.
Figure 5B:
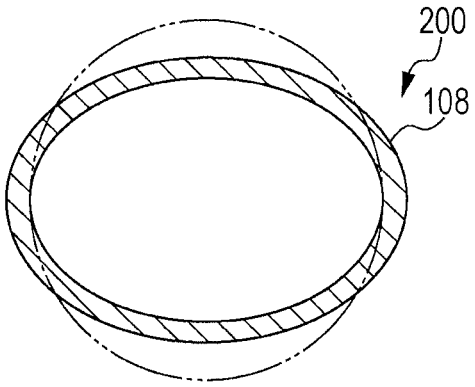

FIGS. 5A and 5B exaggeratedly illustrate an example of a deformed state of a cylindrical body 108 of the image carrier 200 when a periodic electrostatic attractive force is generated between the image carrier 200 and a charging roller 58. Since a transmission member 110 and a support member 112 are fixed to opposite ends of the cylindrical body 108 in the apparatus depth direction (see FIG. 2), deformation of a cross section of the cylindrical body 108 is suppressed at the opposite ends in the apparatus depth direction. In contrast, in the center portion of the cylindrical body 108 in the apparatus depth direction, the cross section of the cylindrical body 108 periodically deforms in an elliptic shape, as illustrated in FIG. 5B.

Figure 6A:
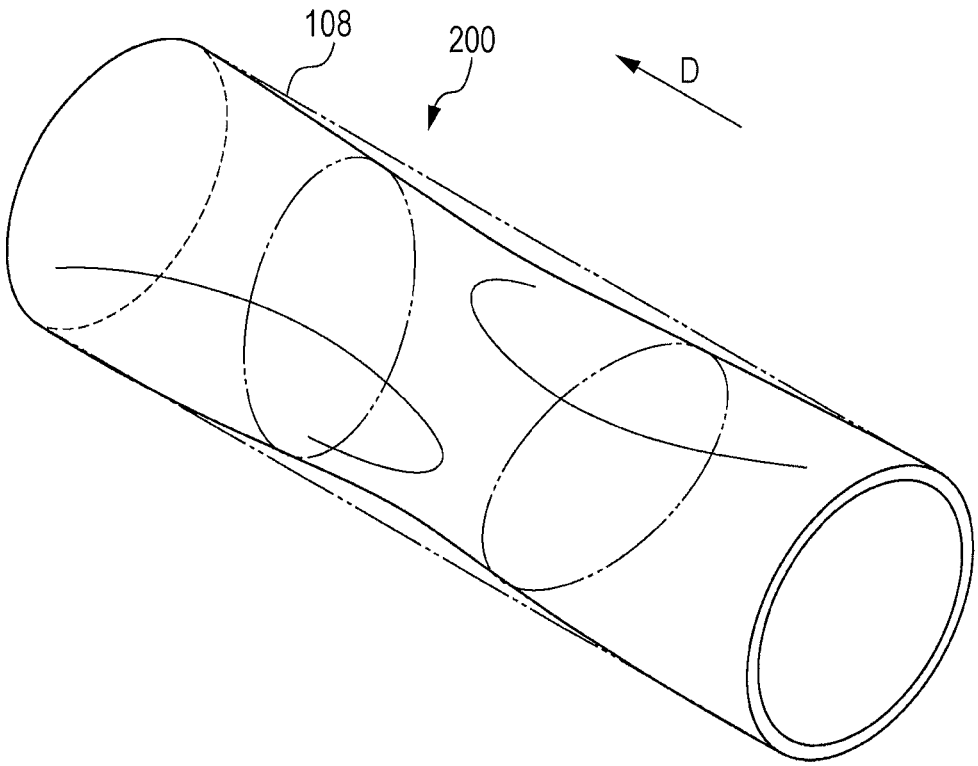
FIGS. 6A, 6B, and 6C are a perspective view, a cross-sectional view, and a cross-sectional view, respectively, illustrating the deformed state of the image carrier according to the first comparative example in contrast to the image carrier of the first exemplary embodiment.
Figure 6B:
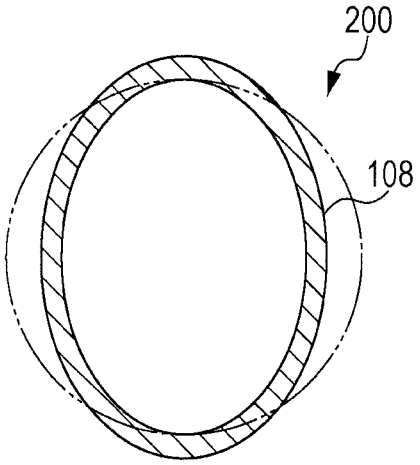
Figure 6C:
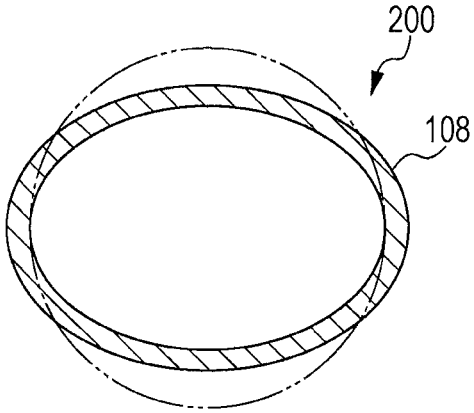

Similarly, FIGS. 6A, 6B, and 6C exaggeratedly illustrate another example of a deformed state of the cylindrical body 108 of the image carrier 200 when a periodic electrostatic attractive force is generated between the image carrier 200 and the charging roller 58. As described above, deformation of the cross section of the cylindrical body 108 is suppressed at the opposite ends of the cylindrical body 108 in the apparatus depth direction. In contrast, between the center portion and one end of the cylindrical body 108 in the apparatus depth direction, the cross section of the cylindrical body 108 is deformed in a vertical elliptic shape by the above-described periodic electrostatic attractive force, as illustrated in FIG. 6B. Between the center portion and the other end of the cylindrical body 108 in the apparatus depth direction, the cross section of the cylindrical body 108 is deformed in a horizontal elliptic shape, as illustrated in FIG. 6C.

Next, the image carrier 204 will be described. The image carrier 204 has a structure similar to that of the image carrier 56 except that the shape of a contact member 206 is different from that of the contact member 116.

The contact member 206 has a structure similar to that of the contact member 116 except that contact portions 136 are formed in four areas, not in three areas, in contrast to the contact member 116. Specifically, as illustrated in FIGS. 7A and 7B, each of the contact portions 136 of the contact member 206 is formed by one projection 208. In a state in which the contact member 206 is disposed within the cylindrical body 108, all angles formed by two adjacent straight lines of the straight lines passing through the contact portions 136 and the axial center F of the cylindrical body 108 (image carrier 204) are 90 degrees (angle M in FIG. 7B).

Figure 7B:
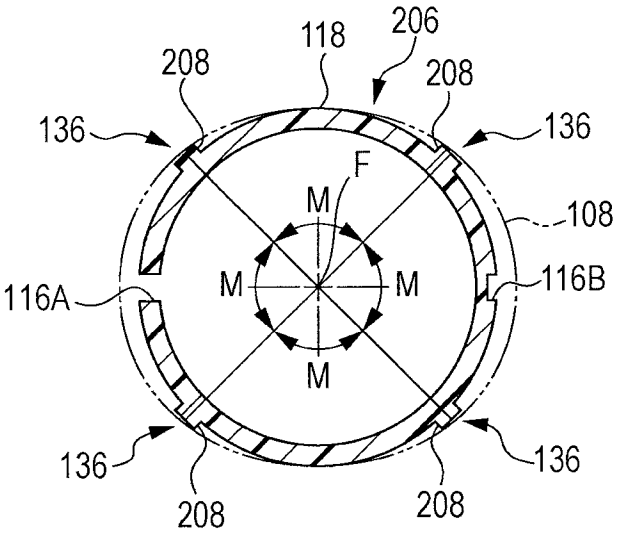
FIGS. 7A and 7B are cross-sectional views of an image carrier according to a second comparative example in contrast to the image carrier of the first exemplary embodiment.
Figure 7A:
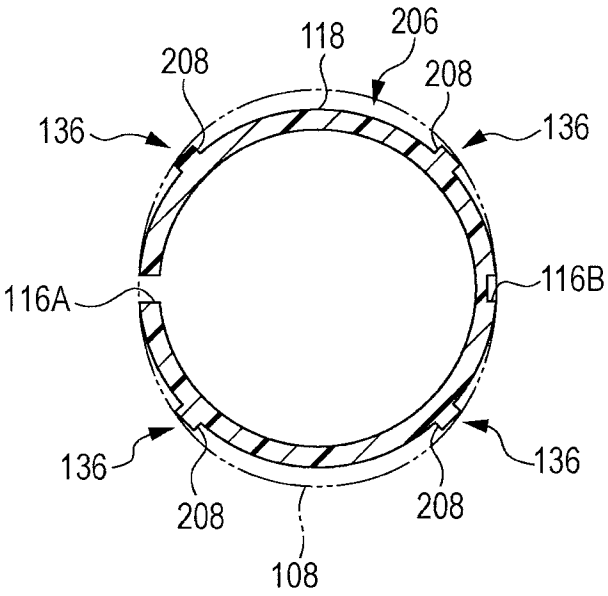

For this reason, as illustrated in FIGS. 7A and 7B, in the image carrier 204, when the cross section of the cylindrical body 108 periodically deforms in a vertical elliptic shape and a horizontal elliptic shape, deformation of the cross section of the cylindrical body 108 is not suppressed.

However, unlike the image carriers 200 and 204 of the first and second comparative examples, the image carrier 56 of the first exemplary embodiment has the contact member 116, and the contact portions 136 of the contact member 116 are provided in three areas on the outer peripheral surface 118, as illustrated in FIG. 1C. Further, in the state in which the contact member 116 is disposed within the cylindrical body 108, all angles formed by two of the straight lines passing through the contact portions 136 and the axial center F of the cylindrical body 108 (image carrier 56) are 120 degrees (angle N in FIG. 1C).

For this reason, even when the cross section of the cylindrical body 108 is going to deform in an elliptic shape, deformation of the cross section of the cylindrical body 108 (image carrier 56) in the elliptic shape may be suppressed by the contact portions 136 in three areas. In other words, periodic deformation of the cross section of the cylindrical body 108 may be suppressed when the surface of the image carrier 56 is charged by the charging roller 58.

Since periodic deformation of the cross section of the cylindrical body 108 is suppressed, sound produced by the periodic deformation may be reduced.

Since the contact portions 136 are provided in three areas on the outer peripheral surface 118, they are in contact with the inner peripheral surface 108A of the cylindrical body 108 even if there are manufacturing variations in the heights of the projections 138, 140, and 142.

The separate portion 116A and the groove portion 116B are provided in the contact member 116, and the contact member 116 is disposed within the cylindrical body 108 while being bent with the groove portion 116B being deformed. That is, the contact member 116, in which the contact portion 136B is provided on one side of the groove portion 116B and the contact portion 136C is provided on the other side of the groove portion 116B, is disposed in a bent state within the cylindrical body 108. Thus, the contact portions 136 in three areas may be in contact with the inner peripheral surface 108A of the cylindrical body 108 in a better-balanced manner than when the contact portions are provided in two areas on one side of the groove portion 116B.

Second Exemplary Embodiment

Figure 8A:
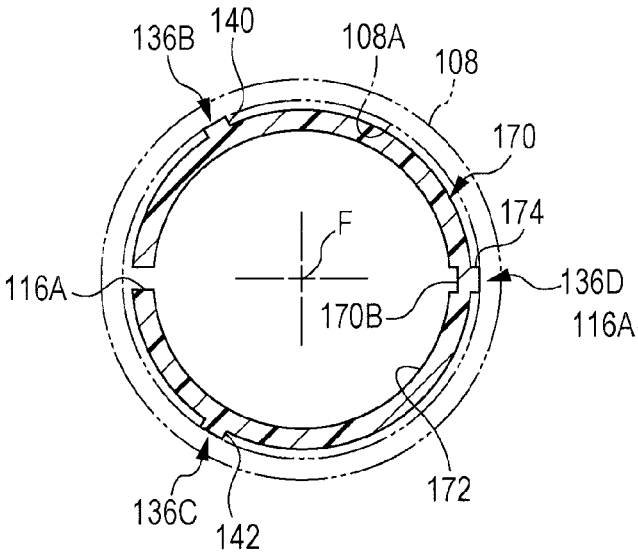
FIGS. 8A, 8B, and 8C are cross-sectional views of contact members according to second, third, and fourth exemplary embodiments of the present invention, respectively.

Next, a contact member, an image carrier, and an image forming apparatus according to a second exemplary embodiment of the present invention will be described with reference to FIG. 8A. The same components as those adopted in the first exemplary embodiment are denoted by the same reference numerals, and descriptions thereof are skipped. The following description will be given with a focus on differences from the first exemplary embodiment.

A groove portion 170B of a contact member 170 according to the second exemplary embodiment is provided in an inner peripheral surface 172 of the contact member 170 on a side of the axial center F of a cylindrical body 108 opposite from a separate portion 116A. A contact portion 136D is formed by one projection 174 disposed on an opposite side from the groove portion 170B, when viewed from the apparatus depth direction. The operation is similar to that of the first exemplary embodiment.

Third Exemplary Embodiment

Figure 8B:
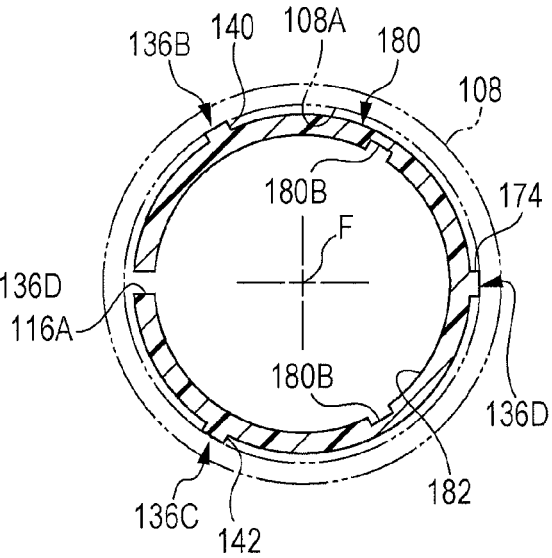

Next, a contact member, an image carrier, and an image forming apparatus according to a third exemplary embodiment of the present invention will be described with reference to FIG. 8B. The same components as those adopted in the second exemplary embodiment are denoted by the same reference numerals, and descriptions thereof are skipped. The following description will be given with a focus on differences from the second exemplary embodiment.

Groove portions 180B of a contact member 180 according to the third exemplary embodiment are provided in two areas on an inner peripheral surface 182 of the contact member 180. Specifically, the groove portions 180B are provided in a portion of the inner peripheral surface 182 between a projection 140 and a projection 174 and a portion of the inner peripheral surface 182 between a projection 142 and the projection 174. The operation is similar to that of the second exemplary embodiment.

Fourth Exemplary Embodiment

Figure 8C:
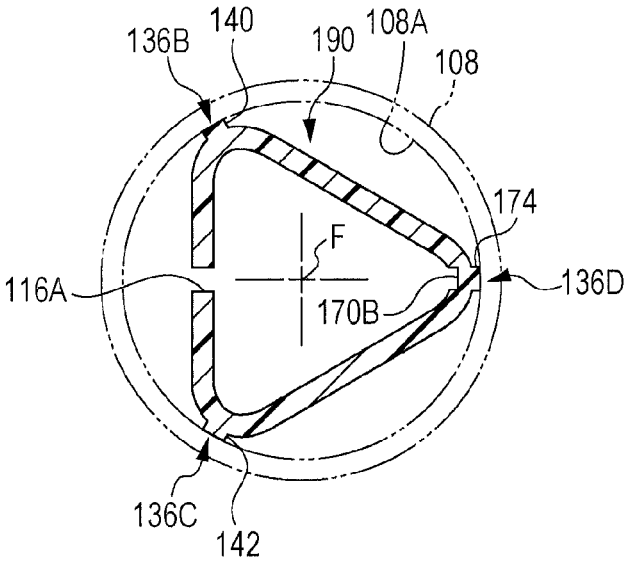

Next, a contact member, an image carrier, and an image forming apparatus according to a fourth exemplary embodiment of the present invention will be described with reference to FIG. 8C. The same components as those adopted in the second exemplary embodiment are denoted by the same reference numerals, and descriptions thereof are skipped. The following description will be given with a focus on differences from the second exemplary embodiment.

A contact member 190 according to the fourth exemplary embodiment is not shaped like a circular cylinder, but is shaped like a triangular cylinder. The operation is similar to that of the second exemplary embodiment Fifth Exemplary Embodiment Next, a contact member, an image carrier, and an image forming apparatus according to a fifth exemplary embodiment of the present invention will be described with reference to FIGS. 9A and 9C to 11A, 11B, and 11C. The same components as those adopted in the first exemplary embodiment are denoted by the same reference numerals, and descriptions thereof are skipped. The following description will be given with a focus on differences from the first exemplary embodiment.

Structure

Figure 9A:
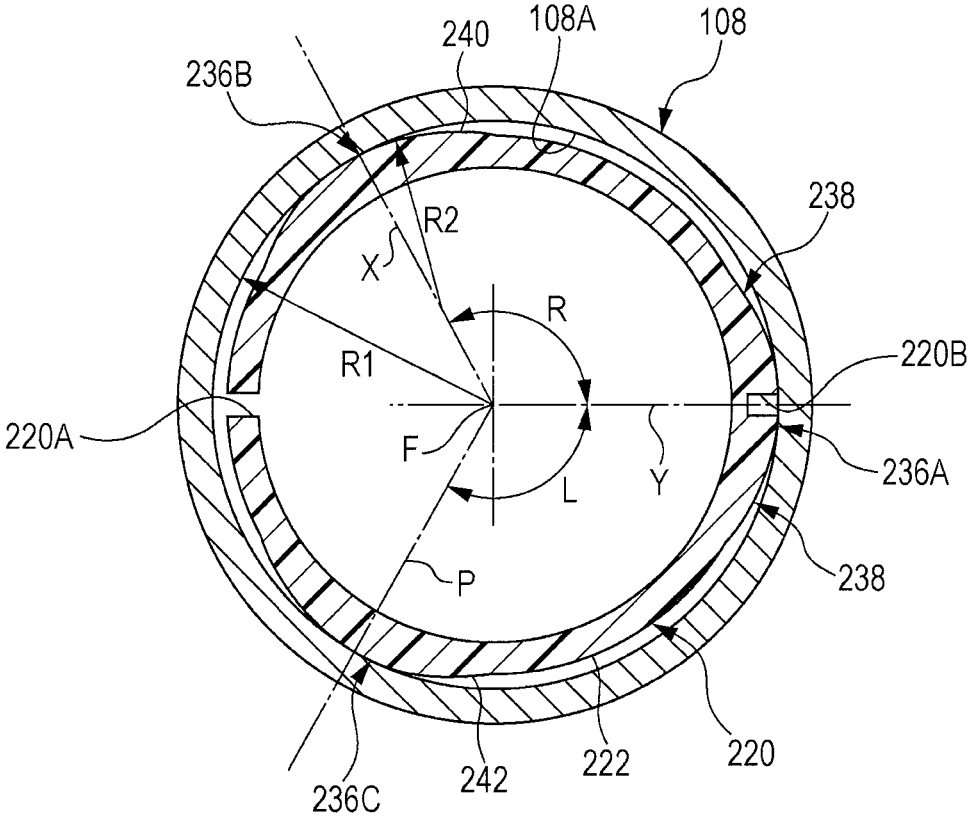
FIGS. 9A and 9B are a cross-sectional view and an enlarged sectional view, respectively, of a contact member according to a fifth exemplary embodiment of the present invention.
Figure 9B:
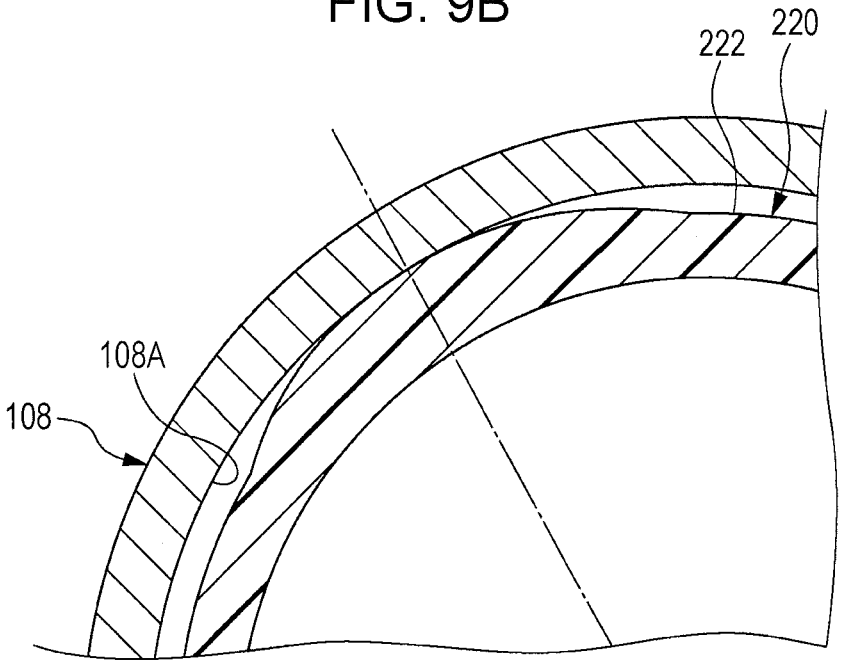

As illustrated in FIGS. 9A and 9B, a contact member 220 according to the fifth exemplary embodiment is partly separated in the circumferential direction to form a separate portion 220A. In a state in which the contact member 220 is disposed within a cylindrical body 108, a groove portion 220B extending in the apparatus depth direction (axial direction) is provided on an outer peripheral surface 222 of the contact member 220 on a side of the axial center F of the cylindrical body 108 opposite from the separate portion 220A.

The outer peripheral surface 222 of the contact member 220 also has a contact portion 236A composed of a pair of projections 238 disposed on opposite sides of the groove portion 220B and provided in contact with an inner peripheral surface 108A of the cylindrical body 108, when viewed from the apparatus depth direction. The outer peripheral surface 222 also has a contact portion 236B formed by a projection 240 provided on one side (counterclockwise side in the figures) of the contact portion 236A, and a contact portion 236C formed by a projection 242 provided on the other side (clockwise side in the figures) of the contact portion 236A.

The contact portions 236B and 236C are arc-shaped or substantially arc-shaped to have a radius less than a radius (inner radius) of the inner peripheral surface 108A of the cylindrical body 108, when viewed from the apparatus depth direction. In the fifth exemplary embodiment, for example, the radius (radius R1 in the figure) of the inner peripheral surface 108A of the cylindrical body 108 is 14.25 mm, and the radius (radius R2 in the figure) of the contact portions 236B and 236C is 10 mm.

Evaluation

Next, a description will be given of results of evaluation of the contact positions where the contact portions 236 (236A, 236B, and 236C) and the inner peripheral surface 108A of the cylindrical body 108 are in contact with each other when the contact member 220 of the fifth exemplary embodiment is disposed within the cylindrical body 108 and the ambient temperature is changed to a low temperature (10° C.), a room temperature (20° C.), and a high temperature (50° C.). The evaluation is performed using simulation in a finite element method.

In the evaluation, aluminum is used as the material of the cylindrical body 108, and ABS resin is used as the material of the contact member 220. As described above, the radius of the inner peripheral surface 108A of the cylindrical body 108 is 14.25 mm, and the radius of the contact portions 236 is 10 mm.

Figure 10:
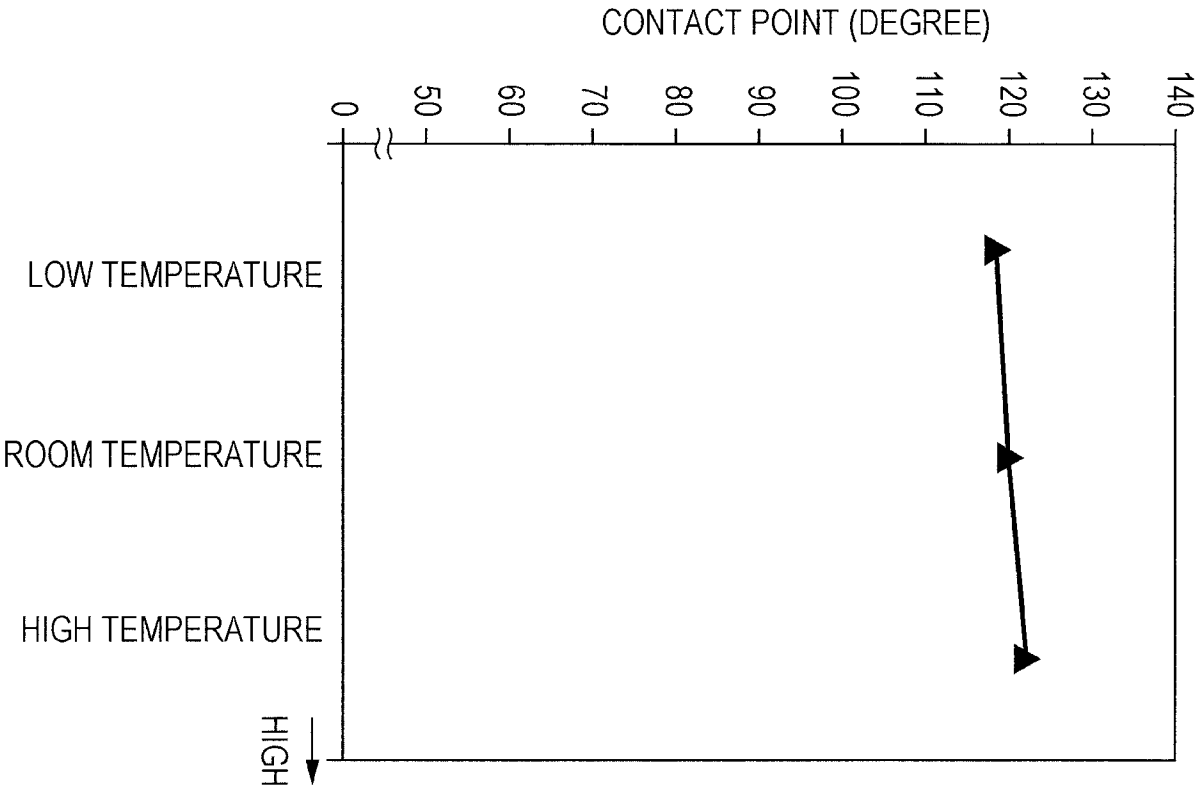
FIG. 10 shows evaluation results of the contact member of the fifth exemplary embodiment.

In a graph of FIG. 10, the vertical axis shows the angle R (angle L) in FIG. 9A, and the horizontal axis shows the ambient temperature near the cylindrical body 108 in which the contact member 220 is disposed. As illustrated in FIG. 9A, the angle R (angle L) is formed by a line segment Y extending from the axial center F and passing through the center of the groove portion 220B and a line segment X (line segment P) extending from the axial center F and passing through the contact position between the contact portion 236B (contact portion 236C) and the inner peripheral surface 108A.

At the room temperature, the angle R (angle L) is 120 degrees. When the ambient temperature is increased or decreased, the shape of the cylindrical body 108 and the shape of the contact member 220 change relative to each other because of the difference between the linear expansion coefficient of the cylindrical body 108 and the linear expansion coefficient of the contact member 220. Thus, the contact position between the contact portion 236B (contact portion 236C) and the inner peripheral surface 108A changes. However, since the contact portions 236B and 236C are arc-shaped or substantially arc-shaped, the change of the angle R (angle L) is smaller than in a comparative example (to be described below) even when the ambient temperature changes to a low temperature or a high temperature, as shown in the graph of FIG. 10.

Figure 11A:
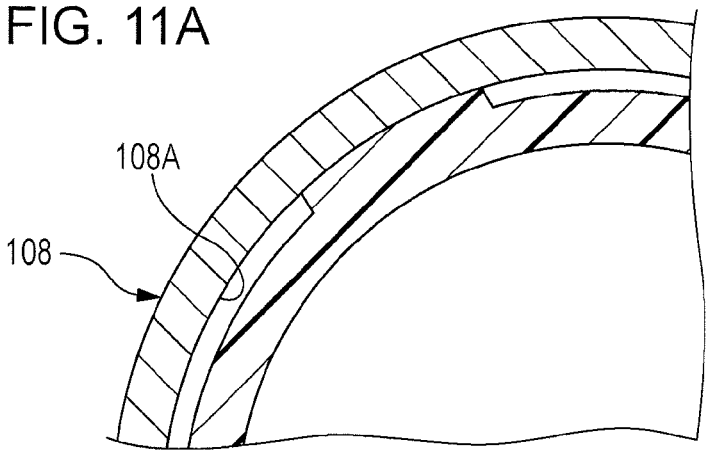
FIGS. 11A, 11B, and 11C are cross-sectional views of a contact member according to a comparative example in contrast to the contact member of the fifth exemplary embodiment.
Figure 11B:
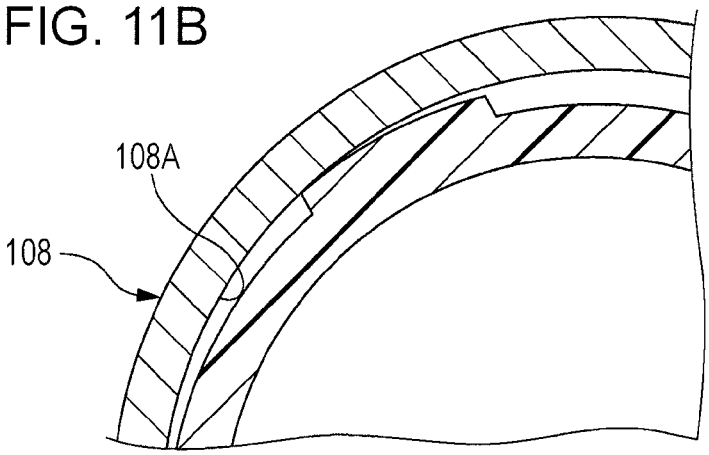
Figure 11C:
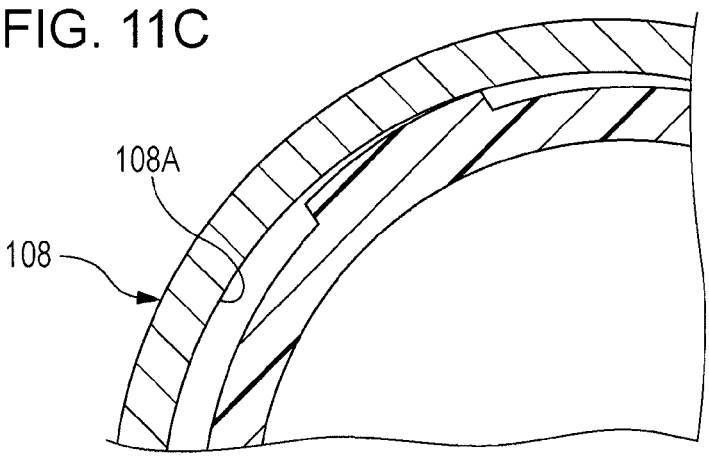

In the comparative example, as illustrated in FIG. 11A, a contact portion and an inner peripheral surface 108A are in surface contact with each other at the room temperature. However, as illustrated in FIGS. 11B and 11C, at a low temperature or a high temperature, the contact position therebetween is moved owing to the relative change of the shapes of a cylindrical body 108 and a contact member.

Operation and Conclusion

The contact portions 236B and 236C are arc-shaped or substantially arc-shaped, when viewed from the apparatus depth direction. For this reason, the contact positions between the contact portions 236 and the inner peripheral surface 108A may be restricted from varying owing to the change in ambient temperature more than when the contact portions and the inner peripheral surface 108A are in surface contact with each other.

The contact portions 236B and 236C are arc-shaped or substantially arc-shaped, when viewed from the apparatus depth direction. For this reason, similar to the operation in response to the change in ambient temperature, the contact positions between the contact portions 236 and the inner peripheral surface 108A may be restricted from varying owing to variation in the shape of the cylindrical body 108 or the shape of the contact member 220 relative to the designed value.

When the variation in contact positions between the contact portions 236 and the inner peripheral surface 108A is suppressed, variation in the natural frequency of the image carrier 56 may be suppressed.

In the image carrier 56, uneven charging may be suppressed because the variation in the natural frequency is suppressed.

Sixth Exemplary Embodiment

Next, a contact member, an image carrier, and an image forming apparatus according to a sixth exemplary embodiment of the present invention will be described with reference to FIG. 12. The same components as those adopted in the fifth exemplary embodiment are denoted by the same reference numerals, and descriptions thereof are skipped. The following description will be given with a focus on differences from the fifth exemplary embodiment.

Figure 12:
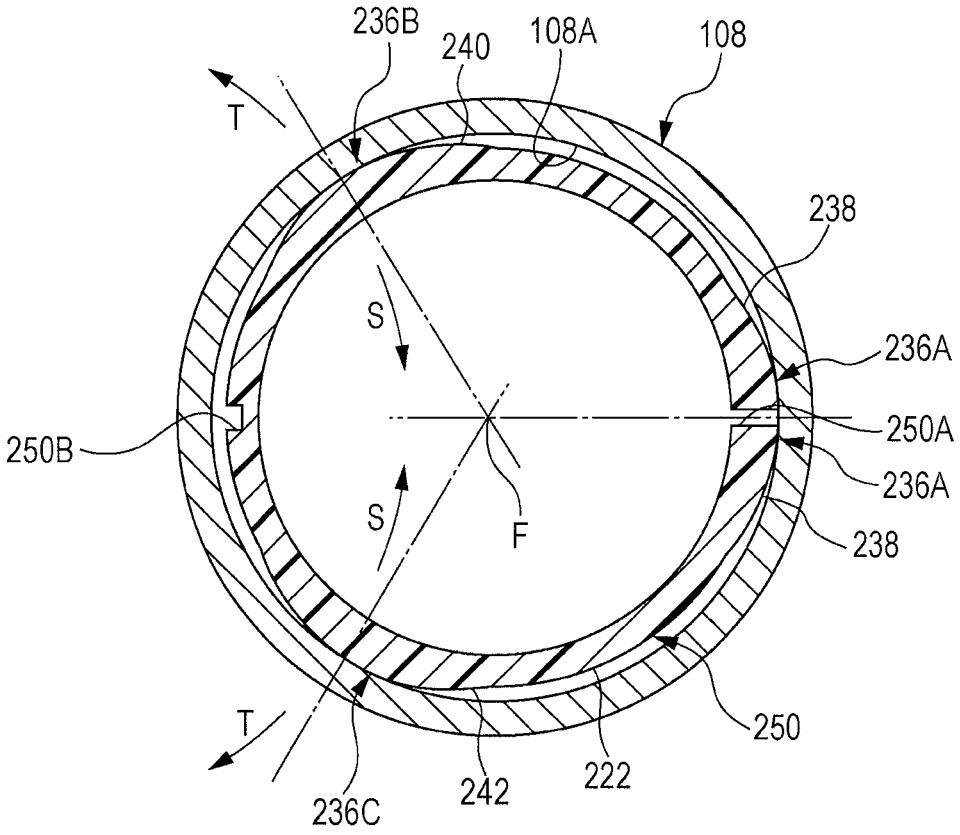
FIG. 12 is a cross-sectional view of a contact member according to a sixth exemplary embodiment of the present invention.

As illustrated in FIG. 12, unlike the fifth exemplary embodiment, a separate portion 250A of a contact member 250 according to the sixth exemplary embodiment is disposed to extend across a projection 238. Further, unlike the fifth exemplary embodiment, a groove portion 250B of the contact member 250 of the sixth exemplary embodiment is disposed on a side of the axial center F opposite from the separate portion 250A.

For this reason, when the contact member 250 is disposed within the cylindrical body 108 while deforming the groove portion 250B and bending the contact member 250 in directions of arrows S, a contact portion 236B (236C) presses an inner peripheral surface 108A in directions of arrows T in the figure. Hence, pressing force of the contact portion 236B (236C) for pressing the inner peripheral surface 108A may be more effectively transmitted to the cylindrical body 108 than when the inner peripheral surface 108A is pressed in a tangential direction of the contact portion 236B (236C) at the contact position between the contact portion 236B (236C) and the inner peripheral surface 108A.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, in the above embodiments, all angles formed by two of the straight lines passing through the contact portions 136 and the axial center F of the cylindrical body 108 (image carrier 56) are 120 degrees in the state in which the contact member 116, 170, 180, or 190 is disposed within the cylindrical body 108. However, the angles do not always need to be 120 degrees, and it is only necessary that all the angles formed by the two straight lines should be more than 90 or about 90 degrees.

Although not particularly described in conjunction with the above exemplary embodiments, when plural projections are provided in the contact portions, it is only necessary that all the angles (angles J in FIG. 1C) formed by two of the straight lines passing through the projections formed at the adjacent contact portions and the axial center F of the cylindrical body 108 should be 90 or more degrees.

Although not particularly described in conjunction with the above exemplary embodiments, the groove portions 116B, 170B, and 180B provided in the contact portions 116, 170, 180, and 190 may be, for example, rectangular, V-shaped, or U-shaped.

While the projections extend in the apparatus depth direction on the contact member in the above exemplary embodiments, they may be partly separated.

While the groove portions 116B, 170B, and 180B are provided in the contact members 116, 170, 180, and 190 in the above exemplary embodiments, they are not always need to be provided.

While the contact portions extend in the apparatus depth direction in the above exemplary embodiments, they may be helically formed on the outer peripheral surface of the contact member.

While the contact member is formed of ABS resin in the above exemplary embodiments, it may be formed of other materials (for example, a resin material or a metal material).

While the contact portions 236B and 236C are arc-shaped or substantially arc-shaped in the fifth and sixth exemplary embodiments, it is only necessary that at least one contact portion 236 should be arc-shaped or substantially arc-shaped.

While the contact portions 236B and 236C are arc-shaped or substantially arc-shaped in the fifth and sixth exemplary embodiments, all of the contact portions 236 may be arc-shaped or substantially arc-shaped by shifting the groove portion or the separate portion.

Figure 13A:
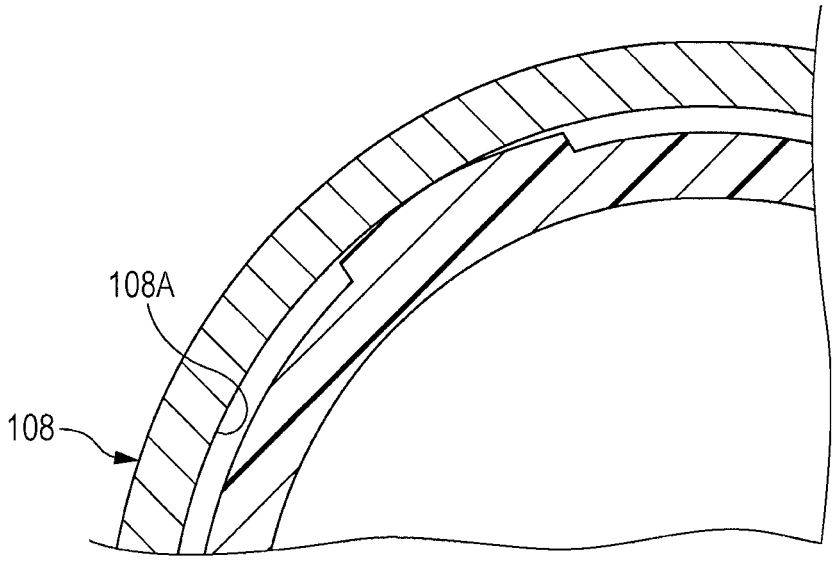
FIGS. 13A and 13B are enlarged views of modifications of the contact members of the fifth and sixth exemplary embodiments, respectively.
Figure 13B:
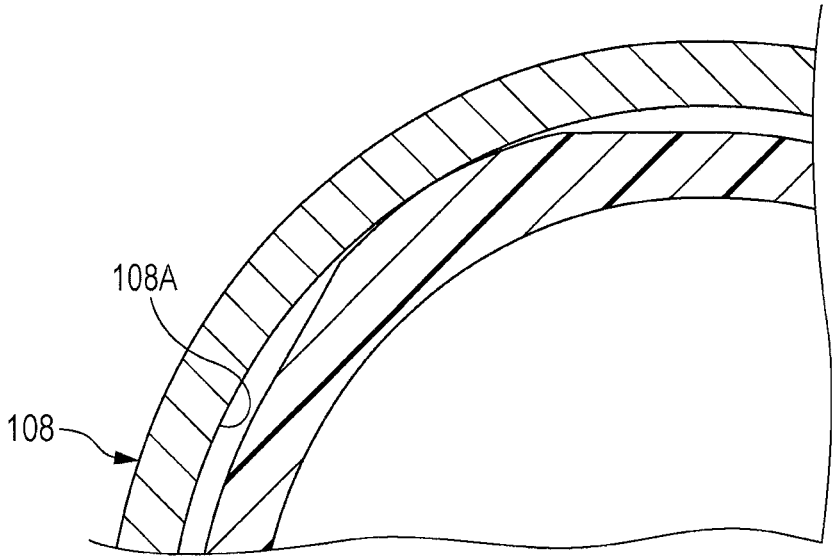

While the contact portions 236B and 236C are arc-shaped or substantially arc-shaped by making the entire projections 240 and 242 arc-shaped in the fifth and sixth exemplary embodiments, it is only necessary that the portions in contact with the inner peripheral surface 108A of the cylindrical body 108 should be arc-shaped or substantially arc-shaped. As illustrated in FIGS. 13A and 13B, portions other than the portions in contact with the inner peripheral surface 108A of the cylindrical body 108 do not always need to be arc-shaped.

What is claimed is:

1. A contact member fitted in a cylindrical body of an image carrier, and supported by the cylindrical body, the contact member comprising:

a plurality of projections extending from an outer peripheral surface of the contact member, the plurality of projections comprising a first projection, a second projection, and a pair of projections that are different from the first and second projections;

a plurality of contact portions, each of the plurality of contact portions being provided on the outer peripheral surface of each of the plurality of projections, in contact with an inner peripheral surface of the cylindrical body, and provided in three areas in a circumferential direction of the cylindrical body, each of the three areas corresponding to a respective outer peripheral surface of the first projection, the second projection and the pair of projections; and a groove portion extending in the axial direction and being disposed between the pair of projections, and being disposed on a side of the axial center opposite from a gap portion of the contact member, the contact member being partly separated in a circumferential direction to form the gap portion, and angles formed by two straight lines passing through two of the contact portions, the contact portions being respectively provided on the plurality of projections, and an axial center of the cylindrical body being about 120 degrees when the contact member is supported within the cylindrical body, and when viewed from an axial direction of the cylindrical body.

2. The contact member according to claim 1, wherein the groove portion is provided in one of the contact portions, and wherein the contact member is disposed within the cylindrical body while being bent with a reduced separate distance of the gap portion.

3. The contact member according to claim 1, wherein at least one of the contact portions is arc-shaped to have a radius less than a radius of the inner peripheral surface of the cylindrical body, when viewed from the axial direction.

4. The contact member according to claim 2, wherein at least one of the contact portions is arc-shaped to have a radius less than a radius of the inner peripheral surface of the cylindrical body, when viewed from the axial direction.

5. An image carrier comprising:

a cylindrical body that bears an image on a surface thereof; and the contact member according to claim 1, the contact member being disposed within the cylindrical body.

6. An image forming apparatus comprising:

the image carrier according to claim 5;

a charging device that charges a surface of the image carrier;

an exposure device that forms an electrostatic latent image by exposing the charged surface of the image carrier; and a developing device that develops the electrostatic latent image formed on the surface of the image carrier into a toner image.

7. The contact member according to claim 1, wherein the contact member is cylindrical.

8. The contact member according to claim 1, wherein the contact member is C-shaped.

* * * * *